US010886608B2

(12) United States Patent
Kim et al.

(10) Patent No.: US 10,886,608 B2
(45) Date of Patent: Jan. 5, 2021

(54) HYBRID FEED TECHNIQUE FOR PLANAR ANTENNA

(71) Applicant: QUALCOMM Incorporated, San Diego, CA (US)

(72) Inventors: Jeong Il Kim, San Diego, CA (US); Jorge Fabrega Sanchez, San Diego, CA (US); Mohammad Ali Tassoudji, San Diego, CA (US); Abbas Abbaspour-Tamijani, San Diego, CA (US); Yu-Chin Ou, San Diego, CA (US); Zhang Jin, San Diego, CA (US); Thomas Myers, San Diego, CA (US)

(73) Assignee: QUALCOMM INCORPORATED, San Diego, CA (US)

( * ) Notice: Subject to any disclaimer, the term of this patent is extended or adjusted under 35 U.S.C. 154(b) by 238 days.

(21) Appl. No.: 15/922,827

(22) Filed: Mar. 15, 2018

(65) Prior Publication Data

US 2018/0269585 A1 Sep. 20, 2018

Related U.S. Application Data

(60) Provisional application No. 62/472,451, filed on Mar. 16, 2017.

(51) Int. Cl.
*H01Q 1/52* (2006.01)
*H01Q 9/04* (2006.01)
(Continued)

(52) U.S. Cl.
CPC ..... *H01Q 1/523* (2013.01); *H01Q 9/0407* (2013.01); *H01Q 9/0457* (2013.01); *H01Q 13/10* (2013.01);
(Continued)

(58) Field of Classification Search
CPC ..... H01Q 1/52; H01Q 1/521; H01Q 1/523; H01Q 1/525; H01Q 9/0407; H01Q 9/045;
(Continued)

(56) References Cited

U.S. PATENT DOCUMENTS 8,004,466 B2 8/2011 Kim et al.
8,368,596 B2 * 2/2013 Tiezzi ..... H01Q 1/3275 343/700 MS
(Continued)

OTHER PUBLICATIONS

Hunerli H.V., et al., "Three Dimensional Microfabricated Broadband Patch and Multifunction Reconfigurable Antennae for 60 GHz Applications", IEEE 9th European Conference on Antennas and Propagation, 2015, 5 Pages.
(Continued)

*Primary Examiner* — Robert Karacsony
(74) *Attorney, Agent, or Firm* — Qualcomm Incorporated

(57) ABSTRACT

In an aspect, an apparatus may be an apparatus for wireless communication. The apparatus for wireless communication may include a transceiver, a memory, and at least one processor coupled to the memory and configured to execute instructions stored in the memory to control the transceiver. In another aspect, an apparatus may be an apparatus for wireless communication. The apparatus for wireless communication may include a patch antenna coupled to the transceiver. The patch antenna includes a patch, a ground plane substantially located with respect to the patch, a probe feed coupled to the patch, and a slot-coupled feed configured to couple to the patch.

24 Claims, 13 Drawing Sheets

(51) Int. Cl.

| | |
|---|---|
| ***H01Q 21/06*** | (2006.01) |
| ***H01Q 25/00*** | (2006.01) |
| ***H01Q 21/00*** | (2006.01) |
| ***H01Q 13/10*** | (2006.01) |
| ***H01Q 15/24*** | (2006.01) |

(52) U.S. Cl.
CPC ..... *H01Q 15/242* (2013.01); *H01Q 21/0075* (2013.01); *H01Q 21/065* (2013.01); *H01Q 25/001* (2013.01)

(58) Field of Classification Search
CPC .. H01Q 9/0457; H01Q 9/0428; H01Q 9/0435; H01Q 21/0006; H01Q 21/0075; H01Q 21/065; H01Q 21/24; H01Q 25/001
See application file for complete search history.

(56) References Cited

U.S. PATENT DOCUMENTS

| | | | | |
|---|---|---|---|---|
| 9,368,860 | B2 | 6/2016 | Hossain | |
| 9,843,102 | B2 | 12/2017 | Lai et al. | |
| 2011/0032154 | A1 | 2/2011 | Chung et al. | |
| 2013/0063310 | A1* | 3/2013 | Mak ..... | H01Q 21/08 343/700 MS |

OTHER PUBLICATIONS

An T., et al., "A Dual-polarized Microstrip Patch Antenna using Hybrid Feed," Electromagnetics, Mar. 2010, vol. 30 (3), pp. 256-268, XP002781932.

International Search Report and Written Opinion—PCT/US2018/022838—ISA/EPO—dated Jul. 17, 2018.

Mishra P.K., et al., "A Review of Broadband Dual Linearly Polarized Microstrip Antenna Designs with High Isolation [Education Column]," IEEE Antennas and Propagation Magazine, Dec. 1, 2014, vol. 56 (6), pp. 238-251, XP011570354.

Sun Z., et al., "Dual-band Dual-polarised Microstrip Array with Fractional Frequency Ratio," Electronics LET, Jun. 7, 2012, vol. 48 (12), pp. 674-676, XP006040920.

Wei K., et al., "A Novel Hybrid-Fed Patch Antenna with Pattern Diversity," IEEE Antennas and Wireless Propagation Letters, Jan. 1, 2010, vol. 9, pp. 562-565, XP011331335.

Woelder K., et al., "Cross-polarization and Sidelobe Suppression in Dual Linear Polarization Antenna Arrays," IEEE Transactions on Antennas and Propagation, Dec. 1, 1997, pp. 1727-1740, XP055483493.

Wong K-L., et al., "Design of Dual Polarized Patch Antennas Fed by Hybrid Feeds," 5th International Symposium on Antennas, Propagation and en Theory, Aug. 15, 2000, pp. 22-25, XP032139058.

* cited by examiner

HYBRID FEED TECHNIQUE FOR PLANAR ANTENNA

CROSS-REFERENCE TO RELATED APPLICATION(S)

This application claims the benefit of U.S. Provisional Application Ser. No. 62/472,451, entitled "HYBRID FEED TECHNIQUE FOR PLANAR ANTENNA" and filed on Mar. 16, 2017, which is expressly incorporated by reference herein in its entirety.

BACKGROUND

Field

The present disclosure relates generally to communication systems, and more particularly, to techniques for antennas.

Background

Wireless communication systems are widely deployed to provide various telecommunication services such as telephony, video, data, messaging, and broadcasts. Typical wireless communication systems may employ multiple-access technologies capable of supporting communication with multiple users by sharing available system resources. Examples of such multiple-access technologies include code division multiple access (CDMA) systems, time division multiple access (TDMA) systems, frequency division multiple access (FDMA) systems, orthogonal frequency division multiple access (OFDMA) systems, single-carrier frequency division multiple access (SC-FDMA) systems, and time division synchronous code division multiple access (TD-SCDMA) systems.

These multiple access technologies have been adopted in various telecommunication standards to provide a common protocol that enables different wireless devices to communicate on a municipal, national, regional, and even global level. An example telecommunication standard is Long Term Evolution (LTE). LTE is a set of enhancements to the Universal Mobile Telecommunications System (UMTS) mobile standard promulgated by Third Generation Partnership Project (3GPP). LTE is designed to support mobile broadband access through improved spectral efficiency, lowered costs, and improved services using OFDMA on the downlink, SC-FDMA on the uplink, and multiple-input multiple-output (MIMO) antenna technology. However, as the demand for mobile broadband access continues to increase, there exists a need for further improvements in communications technology. These improvements may also be applicable to one or more multi-access technologies and the telecommunication standards that employ these technologies.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

In an aspect of the disclosure, a method, a computer-readable medium, and an apparatus are provided. The apparatus may be a patch antenna. The patch antenna may include a patch, a ground plane located with respect to the patch, a probe feed coupled to the patch, and a slot-coupled feed configured to couple to the patch.

In an aspect of the disclosure, a method, a computer-readable medium, and an apparatus are provided. The apparatus may be an apparatus for wireless communication. The apparatus for wireless communication may include a transceiver, a memory, and at least one processor coupled to the memory and configured to execute instructions stored in the memory to control the transceiver.

The apparatus for wireless communication may include a patch antenna coupled to the transceiver. The patch antenna includes a patch, a ground plane located with respect to the patch, a probe feed coupled to the patch, and a slot-coupled feed configured to couple to the patch.

To the accomplishment of the foregoing and related ends, the one or more aspects comprise the features hereinafter fully described and particularly pointed out in the claims. The following description and the annexed drawings set forth in detail certain illustrative features of the one or more aspects. These features are indicative, however, of but a few of the various ways in which the principles of various aspects may be employed, and this description is intended to include all such aspects and their equivalents.

DETAILED DESCRIPTION

Figure 1:
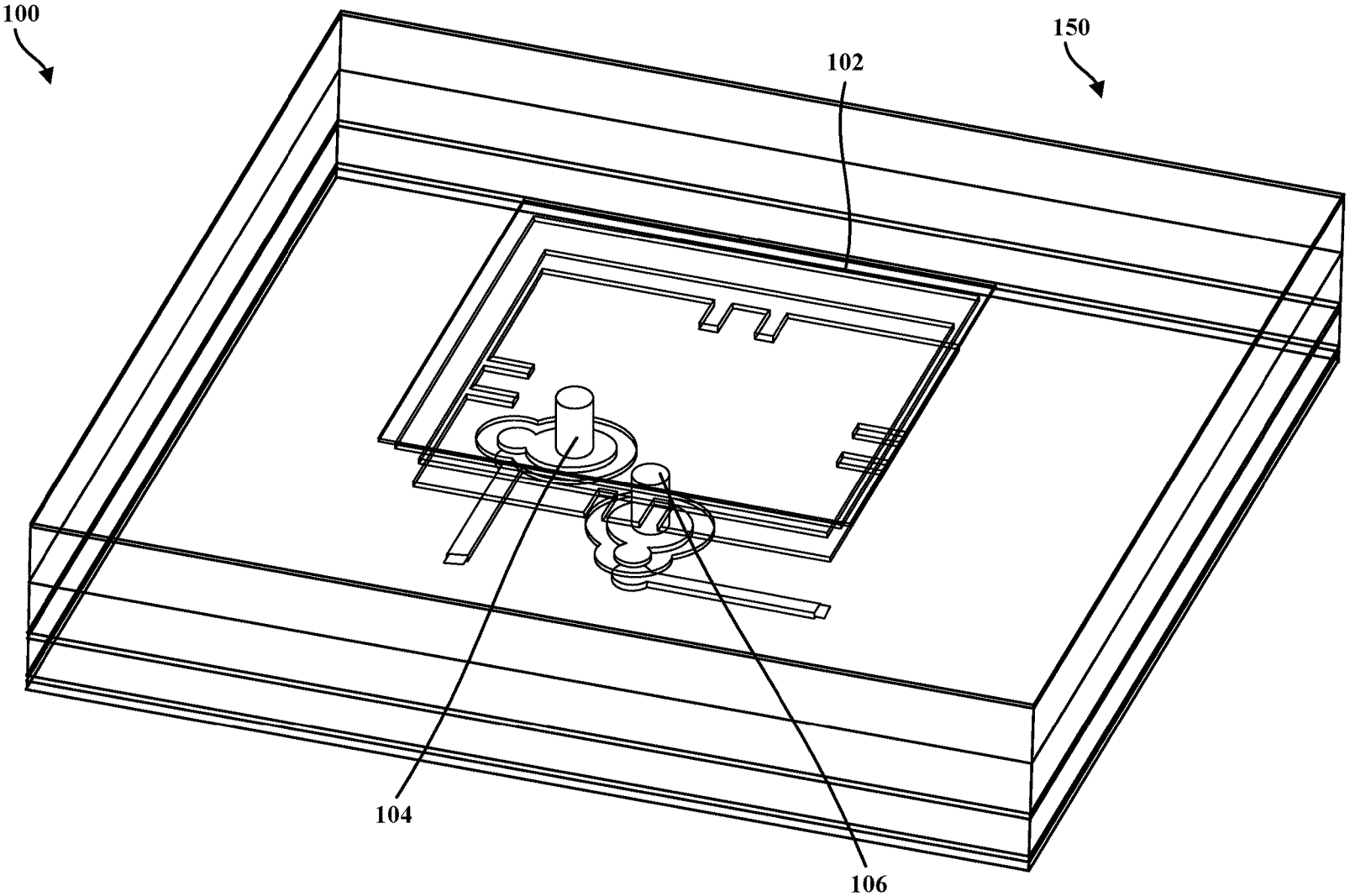
FIG. 1 is a diagram illustrating an example patch antenna.

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well-known structures and components are shown in block diagram form in order to avoid obscuring such concepts.

Several aspects of telecommunication systems will now be presented with reference to various apparatus and methods. These apparatus and methods will be described in the following detailed description and illustrated in the accompanying drawings by various blocks, components, circuits, processes, algorithms, etc. (collectively referred to as "elements"). These elements may be implemented using electronic hardware, computer software, or any combination thereof. Whether such elements are implemented as hardware or software depends upon the particular application and design constraints imposed on the overall system.

By way of example, an element, or any portion of an element, or any combination of elements may be implemented as a "processing system" that includes one or more processors. Examples of processors include microprocessors, microcontrollers, graphics processing units (GPUs), central processing units (CPUs), application processors, digital signal processors (DSPs), reduced instruction set computing (RISC) processors, systems on a chip (SoC), baseband processors, field programmable gate arrays (FPGAs), programmable logic devices (PLDs), state machines, gated logic, discrete hardware circuits, and other suitable hardware configured to perform the various functionality described throughout this disclosure. One or more processors in the processing system may execute software. Software shall be construed broadly to mean instructions, instruction sets, code, code segments, program code, programs, subprograms, software components, applications, software applications, software packages, routines, subroutines, objects, executables, threads of execution, procedures, functions, etc., whether referred to as software, firmware, middleware, microcode, hardware description language, or otherwise.

Accordingly, in one or more example embodiments, the functions described may be implemented in hardware, software, or any combination thereof. If implemented in software, the functions may be stored on or encoded as one or more instructions or code on a computer-readable medium. Computer-readable media includes computer storage media. Storage media may be any available media that can be accessed by a computer. By way of example, and not limitation, such computer-readable media can comprise a random-access memory (RAM), a read-only memory (ROM), an electrically erasable programmable ROM (EEPROM), optical disk storage, magnetic disk storage, other magnetic storage devices, combinations of the aforementioned types of computer-readable media, or any other medium that can be used to store computer executable code in the form of instructions or data structures that can be accessed by a computer.

Some examples may be related to a mmWave antenna module or another antenna module. An aspect may relate to how to reduce coupling between the antenna feeds.

In one example, embodiments herein may provide extreme bandwidths in small cells. Providing extreme bandwidths in small cells may be accomplished by using a phased array antenna in some implementations. The phased array antenna may be used to overcome high signal propagation loss at mmWave frequencies. The phased array antenna may also be used to support multi-user multiple-input and multiple-output (MIMO) through beamforming. In some embodiments, the antenna(s) described herein is implemented in a device configured to communicate pursuant to a 5G telecommunications standard. In some embodiments, the antenna(s) described herein may be configured to operate at one or more mmWave frequencies or in one or more mmWave frequency bands, for example between 30 GHz and 300 GHz, or some subset of these frequencies.

A patch phased array antenna may be configured with dual antenna polarizations, for example for use with MIMO communications, which may be implemented in some configurations as multi-user MIMO. In some implementations dual antenna polarizations may also provide for diversity gain. A patch phased array antenna that has dual antenna polarizations may have dual orthogonal feeds. The dual orthogonal feeds may provide an input for each of the dual antenna polarizations. For example, a first feed of the dual orthogonal feeds may provide an input for a first antenna polarization of the dual antenna polarizations. A second feed of the dual orthogonal feeds may provide an input for a second antenna polarization of the dual antenna polarizations.

It may be beneficial to implement dual probe feeds to a patch antenna with a small footprint in a package. The coupling between two probe feeds, as discussed with respect to FIG. 1, below, may be relatively high due to two proximal probes running in parallel. High coupling between two probe feeds may increase feed line isolation issues and active impedance variation over beam scan angles. Certain embodiments described herein may reduce or substantially eliminate such issues.

In wireless communication, a patch antenna may be an antenna fabricated on a printed circuit board (PCB). A portion of a patch antenna may be referred to as a patch. The patch may be a portion of a metal layer of the PCB, for example as a piece of metal foil. The metal foil (patch) may be formed in various shapes. For example, the patch may be formed on the surface of the PCB in practically any continuous shape possible on the PCB. Additionally, a similar piece of metal (foil) may be used as a ground plane. In some examples, the metal ground plane may be larger than the metal patch. For example, the metal ground plane may be a similar shape as the metal patch, but the metal ground plane may extend beyond the metal patch, e.g., when viewed from above the metal patch.

The metal ground plane may be formed on an opposite side of the PCB from the metal patch. Accordingly, the metal patch may form a plane parallel to the metal ground plane. In some examples, a patch antenna may include multiple patches, e.g., multiple metal patches. The multiple metal patches may be formed in a two-dimensional array of patches. In an example, the antenna may be connected to a transceiver, transmitter, or receiver through a stripline.

A patch antenna may be a wide-beam, narrowband, antenna. The patch antenna may be fabricated on a PCB by etching the patch, ground plane, and other supporting antenna structures (e.g., the feeds) into metal (foil) bonded to the PCB to form traces bonded to the PCB. The PCB may form an insulating dielectric substrate. The ground plane may be formed on the PCB as a continuous metal layer bonded to an opposite side of the substrate from a patch. Patch antennas may have multiple layers of such patches, however. Some example patch antenna shapes may include square, rectangular, circular and elliptical. Other shapes are possible and may include any continuous shape that might be formed on the PCB or other substrate material. A transmission signal may be radiated from one of more of the layers. Thus, one or more of the patches may be configured as a radiator.

In some examples, patch antennas may be fed from underneath via a probe feed. An outer conductor of a coaxial cable may be connected to the ground plane, and a center conductor may be extended up to the patch antenna, e.g., through a pad at the bottom of a patch antenna including a probe feed.

In other examples, patch antennas may be fed using a slot-coupled feed. The slot-coupled feed may use an aperture to feed the antenna. With the slot-coupled feed, the coupling may occur through the dielectric rather than through physical contact. Feed circuitry, such as a transmission line, may be shielded from an antenna by a conducting plane, e.g., a ground plane, having an opening, hole, or slot through which a signal is coupled to the antenna.

One example, as described herein, may be a patch antenna. The patch antenna may include a patch and a ground plane. The ground plane may be located with respect to the patch. For example, the ground plane and the patch may form layers of a circuit board. In an aspect, the patch antenna may include both a probe feed and a slot-coupled feed.

FIG. 1 is a diagram illustrating an example patch antenna 100. The example patch antenna 100 includes a patch 102, a first probe feed 104, and a second probe feed 106. The first probe feed 104 may be configured in the patch antenna 100 so that signals transmitted by the patch antenna 100 that are input to the patch antenna 100 using the first probe feed 104 have a horizontal polarization. Similarly, the second probe feed 106 may be configured in the patch antenna 100 so that signals transmitted by the patch antenna 100 that are input to the patch antenna 100 using the second probe have a vertical polarization.

The first probe feed 104 and the second probe feed 106 may be in close proximity to one another. Additionally, the first probe feed 104 and the second probe feed 106 may be parallel to each other, as illustrated in FIG. 1, e.g., the probe feeds 104, 106 may have pins that run parallel to one another. Because the first probe feed 104 and the second probe feed 106 may be in close proximity to each other and may be parallel to each other, signals on one of the probe feeds (104, 106) may couple on to the other of the probe feeds (106, 104). Accordingly, there may be isolation issues between the first probe feed 104 and the second probe feed 106.

For example, a signal may be input to the first probe feed 104 for transmission by the patch antenna 100. As discussed above, the first probe feed 104 may be used to transmit with horizontal polarization. Accordingly, signals input to patch antenna 100 using the first probe feed 104 may be intended for transmission along a horizontal polarization. However, signals from the first probe feed 104 may couple onto the second probe feed 106 because of the close proximity between the first probe feed 104 and the second probe feed 106 and because the first probe feed 104 and the second probe feed 106 are roughly parallel to each other. As discussed above, the second probe feed 106 may be an input to the patch antenna 100 for a vertical polarization. Accordingly, signals that couple from the first probe feed 104 to the second probe feed 106 may reduce the signal radiated on the non-orthogonal polarization as part of the signal on one port gets coupled into the other port.

Similarly, a signal may be input to the second probe feed 106 for transmission by the patch antenna 100. As discussed above, the second probe feed 106 may be used to transmit with a vertical polarization. Accordingly, signals input to the patch antenna 100 using the second probe feed 106 may be intended for transmission along a vertical polarization. However, signals from the second probe feed 106 may couple onto the first probe feed 104 because of the close proximity between the second probe feed 106 and the first probe feed 104 and because the second probe feed 106 and the first probe feed 104 are substantially parallel to each other.

As discussed above, the first probe feed 104 may be an input to the patch antenna 100 for a horizontal polarization. Accordingly, signals that couple from the second probe feed 106 to the first probe feed 104 may reduce the signal radiated on the non-orthogonal polarization as part of the signal on one port gets coupled into the other port. Additionally, as illustrated in FIG. 1, the antenna 100 may include multiple patch layers (in addition to patch 102). The multiple patch layers may be implemented in a printed circuit board 150. As discussed above, the patch antenna may be fabricated on a PCB by etching the patch, ground plane, and other supporting antenna structures (e.g., the feeds) into metal (foil) bonded to the PCB to form traces bonded to the PCB. The PCB may form an insulating dielectric substrate. The ground plane may be formed on the PCB as a continuous metal layer bonded to an opposite side of the substrate from a patch. Patch antennas may have multiple layers of such patches, however. Some example patch antenna shapes may include square, rectangular, circular and elliptical. Other shapes are possible and may include any continuous shape that might be formed on the PCB or other substrate material. The patch antenna may include a patch and a ground plane. The ground plane may be located with respect to the patch. For example, the ground plane and the patch may form layers of a circuit board. In an aspect, the patch antenna may include probe feeds. In FIG. 1, the probe feeds are illustrated as being cut off to ease representation. In an implementation, the feeds may be connected to signal drivers, e.g., in a transceiver, that may drive signals to the antenna feeds. The signal driver may be a power amplifier (PA) in the transceiver. Additionally, as illustrated in FIG. 1, a patch shown as being disposed beneath patch 102 may include a series of notches that may reduce the overall area of that patch and may improve impedance.

Figure 2:
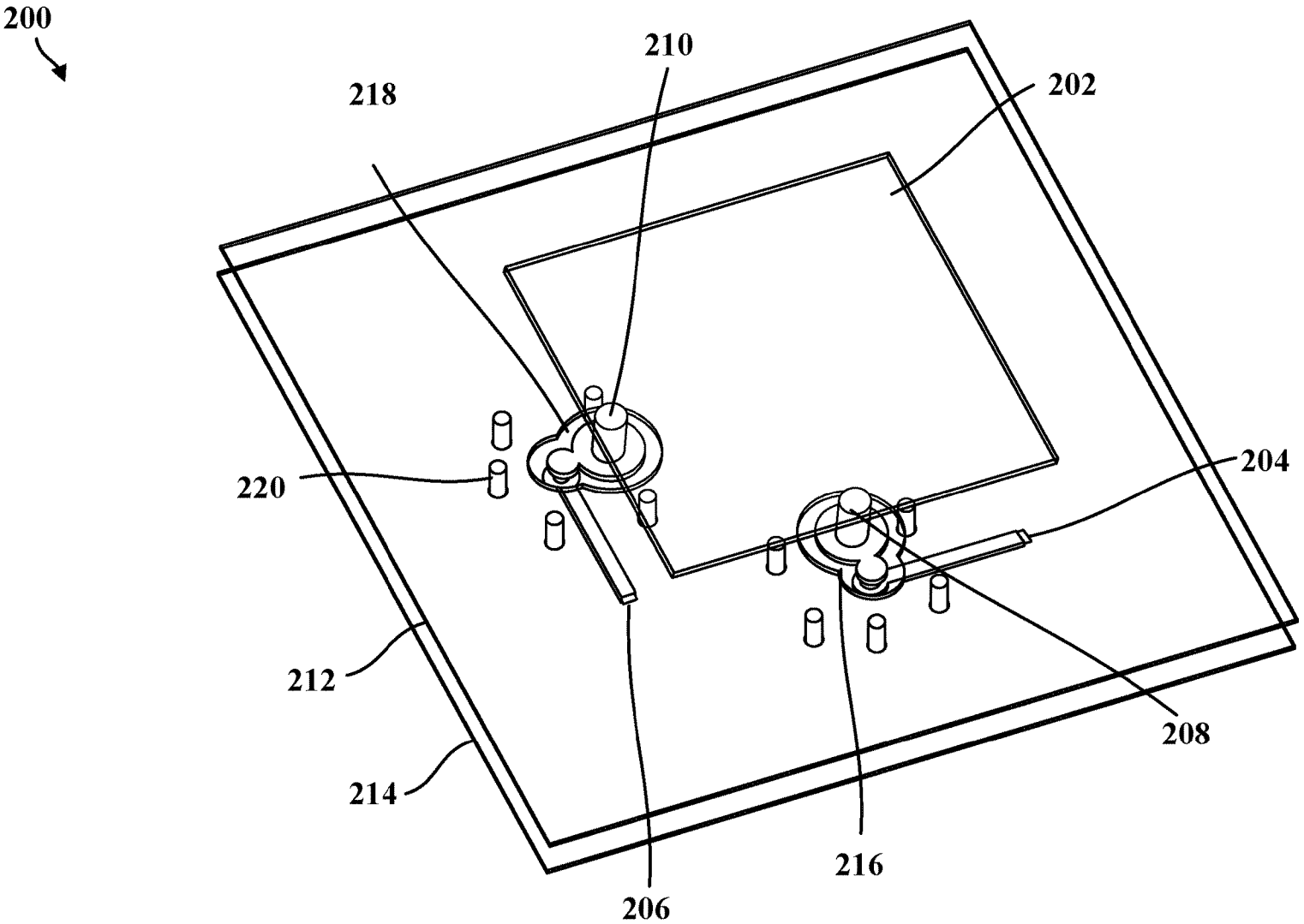
FIG. 2 is a diagram illustrating another example patch antenna.

FIG. 2 is a diagram illustrating another example patch antenna 200. The example patch antenna 200 includes a patch 202, a first probe feed 204, and a second probe feed 206. The first probe feed 204 includes a probe 208. The second probe feed 206 includes a probe 210. The first probe feed 204 may be configured in the patch antenna 200 so that signals transmitted by the patch antenna 200 that are input to the patch antenna 200 using the first probe feed 204 have a horizontal polarization. Similarly, the second probe feed 206 may be configured in the patch antenna 200 so that signals transmitted by the patch antenna 200 that are input to the patch antenna 200 using the second probe the have a vertical polarization.

The first probe feed 204 and the second probe feed 206 may be in close proximity to one another. Additionally, the first probe feed 204 and the second probe feed 206 may have probes 208, 210 that are parallel to each other, as illustrated in FIG. 2. Because the first probe feed 204 and the second probe feed 206 may be in close proximity to each other and may have pins (probes 208, 210) that may be in parallel to each other, signals on one of the probe feeds (204, 206) may couple on to the other of the probe feeds (206, 204). Accordingly, there may be isolation issues between the first probe feed 204 and the second probe feed 206.

As illustrated in FIG. 2, the patch antenna 200 may include a first ground plane 212 and a second ground plane 214. Each ground plane may have a clearance from the probe. The clearance may be a gap or hole in the ground plane(s) 212, 214. Each ground plane may have a clearance from the probe so that the probe is not shorted to the ground plane. For example, the first pin (probe 208) may be configured with a clearance 216 from the first ground plane 212. The second pin (probe 210) may be configured with a clearance 218 from the first ground plane 212. While not clearly visible in the diagram, the first pin (probe 208) and the second pin (probe 210) may also be configured with clearances (not shown) from the second ground plane 214. The clearances may keep the probes 208, 210 from shorting to the ground plane. FIG. 2 also illustrates a plurality of vias 220. The vias 220 may electrically connect the first ground 212 and the second ground 214. In an aspect, the ground planes 212, 214 may be below the patch 202. The vias 220 may provide electrical connections so that the ground planes are shorted together and may both be at a ground potential. In an aspect, ground plane 212 may be a patch ground plane, while ground plane 214 may provide isolation between patch side RF signals and digital, radio frequency (RF), or other signals, e.g., routed underneath the ground plane 214. Accordingly, in aspects of the systems and methods described herein multiple, e.g., two or more, stacked round planes may be used. Additionally, multiple layer patches may be used.

Figure 3:
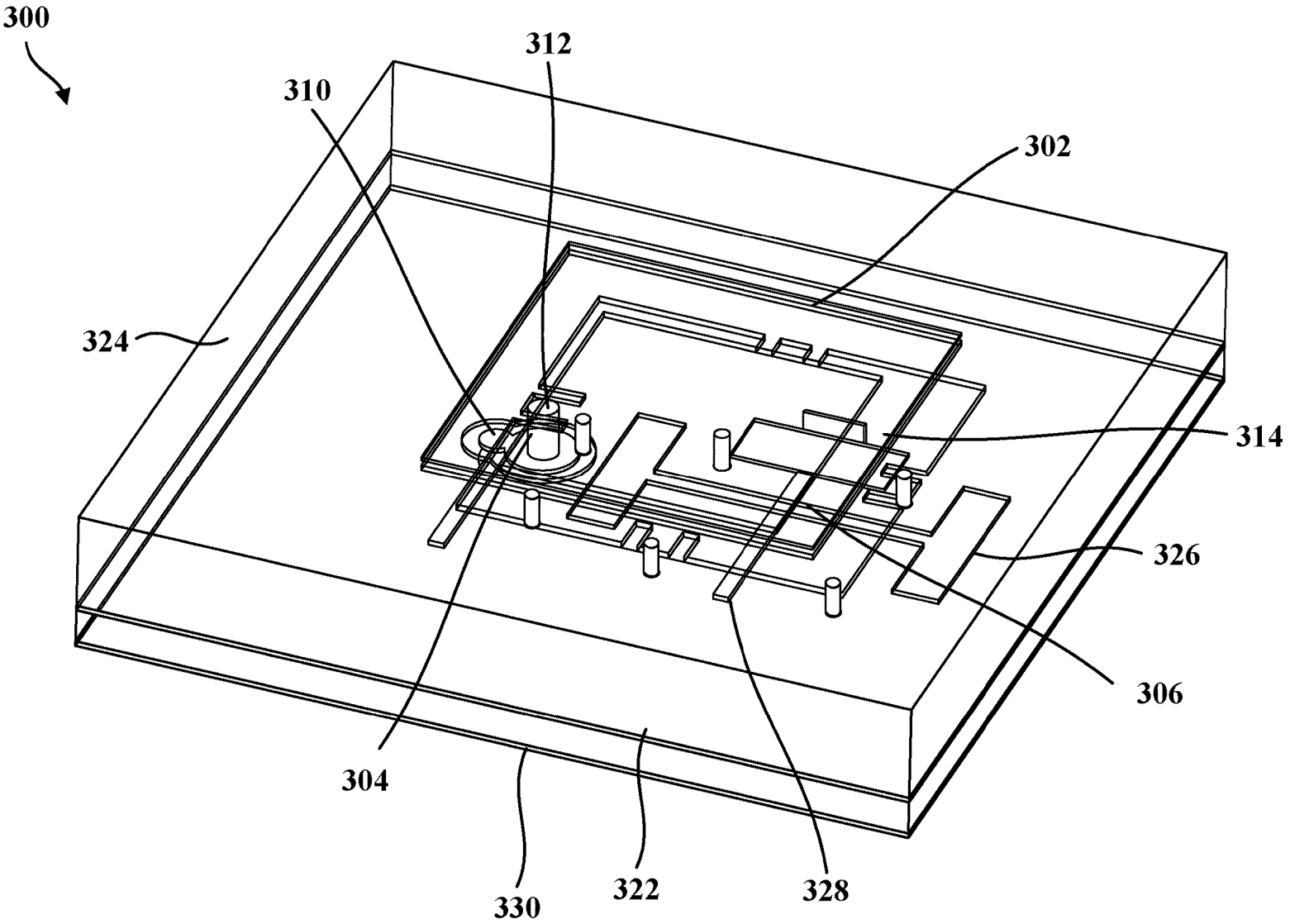
FIG. 3 is a diagram illustrating an example patch antenna.

FIG. 3 is a diagram illustrating an example patch antenna 300. The patch antenna 300 includes a patch 302. The patch antenna 300 may use a hybrid feed technique. For example, the patch antenna 300 includes a probe feed 304 and a slot-coupled feed 306. The patch antenna 300 may therefore be asymmetrically fed by way of 304, 306. In the illustrated example of FIG. 3, the probe feed 304 may connect to the patch antenna 300 in such a way that signals input to the patch antenna 300 through the probe feed 304 are transmitted with a horizontal polarization. Conversely, the slot-coupled feed 306 may connect to the patch antenna 300 in such a way that signals input to the patch antenna 300 through the slot-coupled feed 306 are transmitted with a vertical polarization.

The patch antenna 300 illustrated in FIG. 3 may have improved isolation between a pair of feeds to the patch antenna 300 (e.g., the probe feed 304 and the slot-coupled feed 306), as discussed below. Increased isolation may lead to improved active s-parameters in an array configuration. For example, the slot-coupled feed 306 may be less likely to couple signals onto the probe feed 304. Similarly, the probe feed 304 may be less likely to couple signals onto the slot-coupled feed 306.

Unlike the example patch antenna 100 of FIG. 1, which includes two probe feeds, the first probe feed 104 and the second probe feed 106, that each have a conductor that is in close proximity and runs parallel to the conductor of the other probe feed, the probe feed 304 or the slot-coupled feed 306, with the patch antenna 300 the probe feed 304 and the slot-coupled feed 306 do not include conductors in close proximity running parallel to each other. Accordingly, the probe feed 304 and the slot-coupled feed 306 may be less likely to couple signals between each other. Furthermore, any signal power coupled from the probe feed 304 to the slot-coupled feed 306 or from the slot-coupled feed 306 to the probe feed 304 will likely be much lower in power when compared to having the same signals at the same power levels coupled onto one of the first probe feed 104 or the second probe feed 106 of the patch antenna 100 of FIG. 1 and the patch antenna 200 of FIG. 2. Accordingly, the patch antenna 300 may have better isolation between feeds (e.g., the probe feed 304 and the slot-coupled feed 306) when compared to the patch antennas 100, 200.

Accordingly, signal power coupled onto the slot-coupled feed 306 when a signal input to the patch antenna 300 at the probe feed 304 may be reduced. Consequently, much less signal power from the probe feed 304 will be coupled into the vertical polarization port, which may further increase the power radiated in the horizontal polarization. Conversely, signal power coupled onto the probe feed 304 when signals input to the patch antenna 300 at the slot-coupled feed 306 may be reduced. Consequently, much less signal power from the slot-coupled feed 306 will be coupled into the horizontal polarization port, which may further increase the power radiated in the vertical polarization.

As illustrated in FIG. 3, the patch antenna 200 may include a ground plane 322 and a substrate 324. The patch 302 may generally be parallel to the ground plane 322. (However, in other examples, patch antennas may generally have components equidistant from each other, but following a contour. For example, a patch, ground plane, and feeds may be formed on a curvilinear structure.)

Additionally, the ground plane 322 may include a slot 326 that forms a portion of the slot-coupled feed 306. As illustrated in FIG. 3, the slot-coupled feed 306 also includes a transmission line 328. Signals may be coupled to the patch 302 from the transmission line 328 through the slot 326 of the slot-coupled feed 306. In the illustrated example of FIG. 3, assuming the orientation in the figure, the transmission line 328 is a stripline that runs under the slot 326. The stripline may be sandwiched between the ground plane 322 and another ground plane 330. The slot coupled feed 306 may include a non-resonant aperture in the ground plane 322 that couples the patch 302 (and/or another patch layer) to the transmission line 328. A feature 314 may be included, for example as a simulation port for a slot coupled feed. Another simulation port for the probe feed is not shown. The simulation ports may be sandwiched in between two ground layers (e.g., including ground plane 322, and a bottom ground layer 330).

The probe feed 304 may be connected to a pad 310. The pad 310 may be used to make an electrical connection to the patch antenna 300 (through the probe feed). Accordingly, the pad 310 may be used to connect a signal line to the probe feed 304 so that the antenna may transmit a signal on the signal line. The probe feed 304 may include a pin (probe 312) that couples the pad 310 to the patch 302.

The transmission line 328 may be configured to include the feature 314, which may further improve matching between the patch antenna 300 and the antenna signal lines. The feature 314 may be perpendicular to the rest of the transmission line 328.

An aspect may include the two ground planes 322, 330, as described above. The transmission line 328 may be positioned between the two ground planes 322, 330. The locations of the slot and the probe may be selected to excite the patch 302 in the desired polarization and also to optimize impedance match and isolation between feeds (e.g., probe feed 304, the slot-coupled feed 306).

Figure 4:
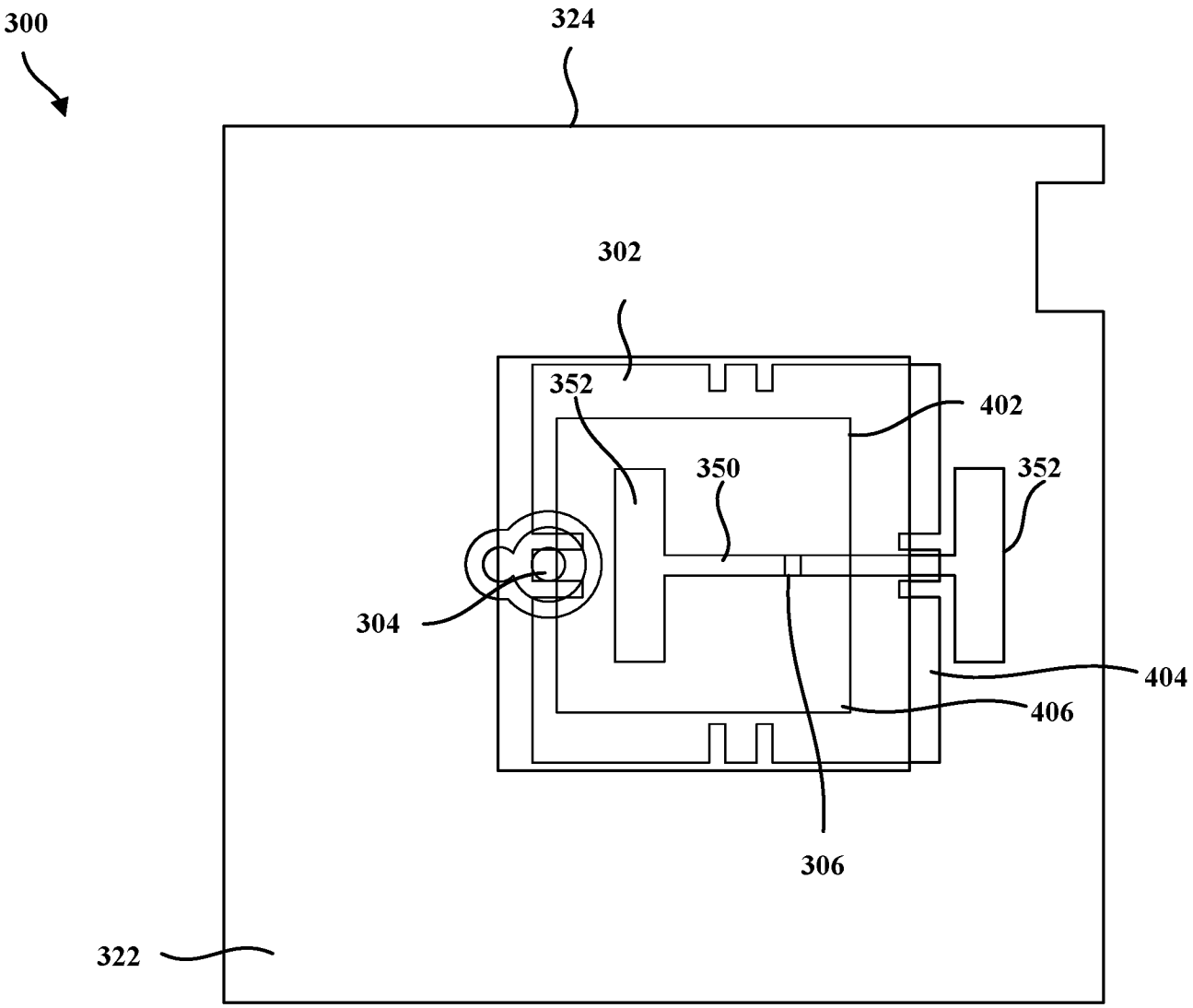
FIG. 4 is another diagram illustrating the example patch antenna of FIG. 3.

FIG. 4 is another diagram illustrating the example patch antenna 300 of FIG. 3. FIG. 4 illustrates the patch antenna 300 in a top-down view. The patch antenna 300 includes the patch 302, the first probe feed 304, the slot-coupled feed 306, and the ground plane 322. As illustrated in FIGS. 3, and 4, the patch antenna 300 may include multiple patches such as the patch 302, and a patch 402, a patch 404 and a patch 406. The patches 302, 402, 404, 406 may generally be stacked on top of each other separated by the substrate 324.

The slot-coupled feed 306 may have a center portion 350 of the example H shape slot of the slot-coupled feed 306 between two parallel portions 352 of the example H shape slot of the slot-coupled feed 306. While FIGS. 3 and 4 illustrate an example using an H shaped slot, it will be understood that other slot shapes may be used. Other examples include a straight slot, a dog-bone shaped slot, a tee shaped slot, or any other shaped slot used in slot coupled antenna feed slots.

Figure 5:
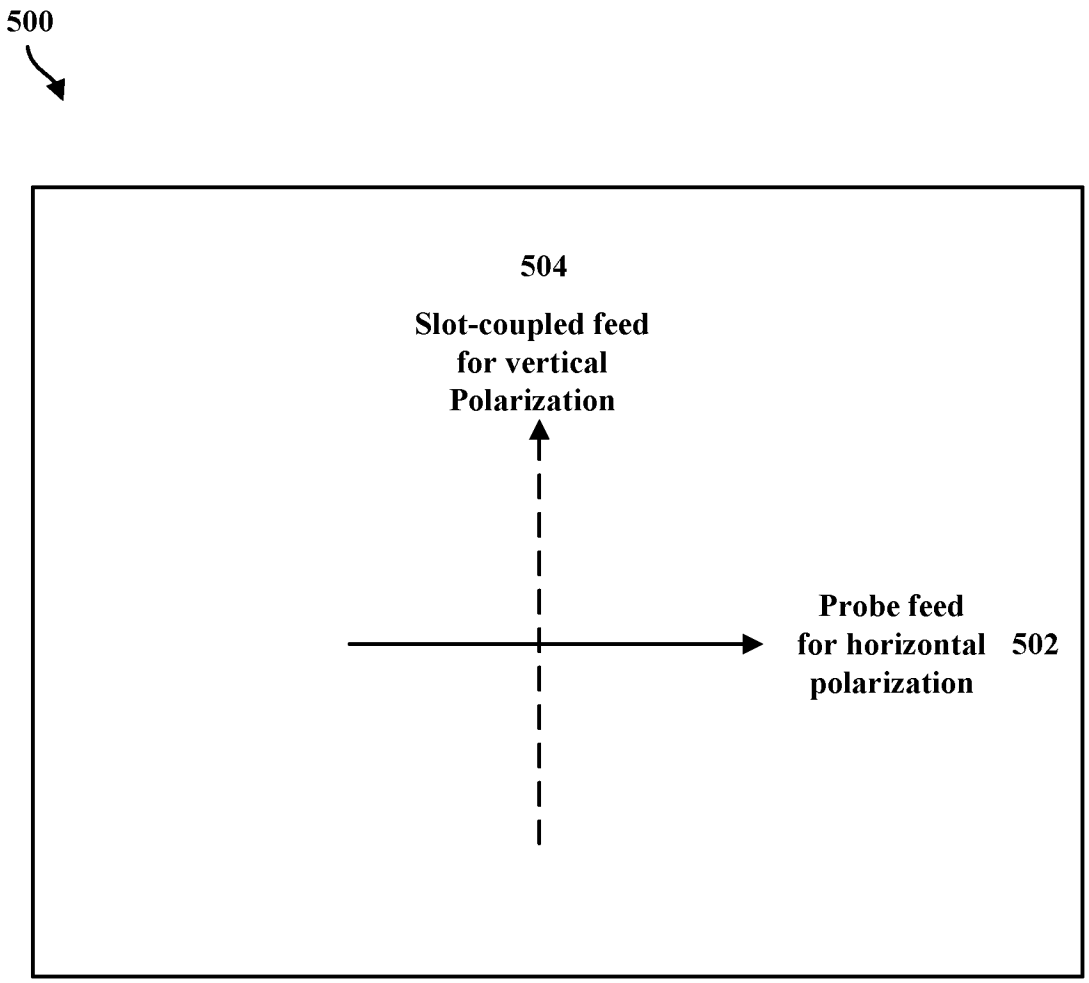
FIG. 5 is a diagram illustrating an example of possible polarizations for the patch antennas of FIGS. 3-4.
Figure 10:
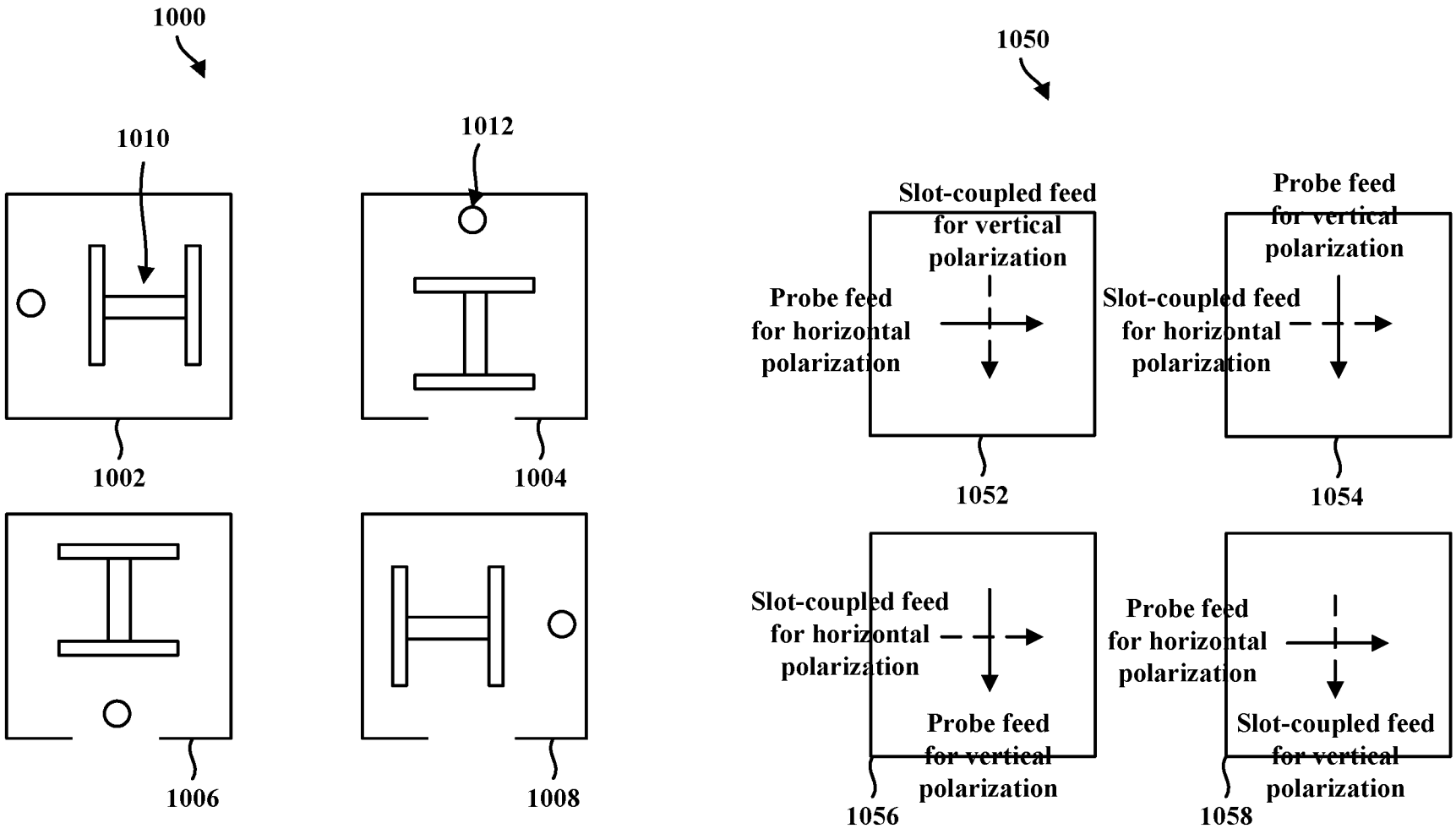
FIG. 10 is a diagram illustrating example antenna slot-coupled feeds and probe feed combinations and polarizations for the example antenna slot-coupled feeds and probe feed combinations.

FIG. 5 is a diagram 500 illustrating an example of possible polarizations for the patch antennas of FIGS. 3-4. As illustrated in diagram 500, the first probe feed 304 may have a horizontal polarization 502. The slot-coupled feed 306 may have a vertical polarization 504. FIGS. 3-4 and the corresponding discussion provide an example of the structures that achieve the vertical and horizontal polarization. The probe feed 304 may provide a horizontal polarization directed perpendicular from the probe feed 304. For example, a signal having a horizontal polarization may radiate from the probe feed 304. The slot-coupled feed 306 may provide a vertical polarization directed from the H shape slot. For example, a signal having a vertical polarization may radiate from the center portion 350 of the H shape slot of the slot-coupled feed 306 between the two parallel portions 352 of the H shape slot of the slot-coupled feed 306. FIG. 10 illustrates component placement and antenna element orientations for various example vertical and horizontal polarizations. While the terms horizontal and vertical are used herein, those of skill in the art will understand that these terms are employed to distinguish between polarizations of the antenna, and do not signify any particular direction with respect to a device in which the antenna may be implemented.

Figure 6:
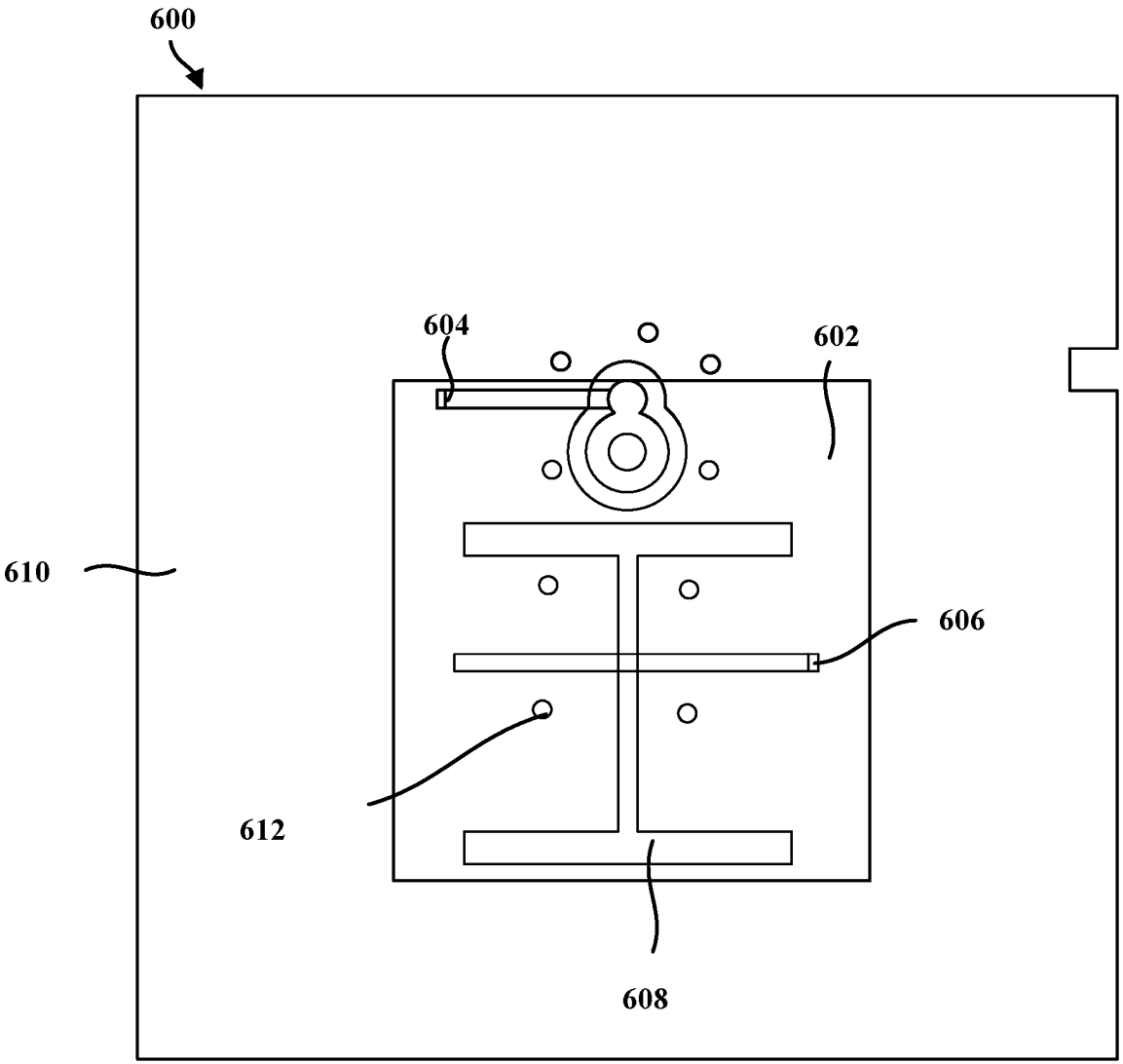
FIG. 6 is a diagram illustrating another example patch antenna having a probe feed and a slot-coupled feed.

FIG. 6 is a diagram illustrating another example patch antenna 600 having a patch 602, a probe feed 604 and a slot-coupled feed 606. Generally, probe feed 604 and slot-coupled feed 606 are configured so that transmitted signals from one feed have a polarization that is orthogonal to signals from the other feed. For instance, the probe feed 604 may connect to the patch antenna 600 in such a way that signals input to the patch antenna 600 through the probe feed 604 are transmitted with a vertical polarization. Conversely, the slot-coupled feed 606 may connect to the patch antenna 300 in such a way that signals input to the patch antenna 300 through the slot-coupled feed 306 are transmitted with a horizontal polarization. The example patch antenna 600 illustrates slots 608 in a first ground plane 610, as well as vias 612 that may connect the ground plane 610 to other ground planes (not illustrated).

Figure 7:
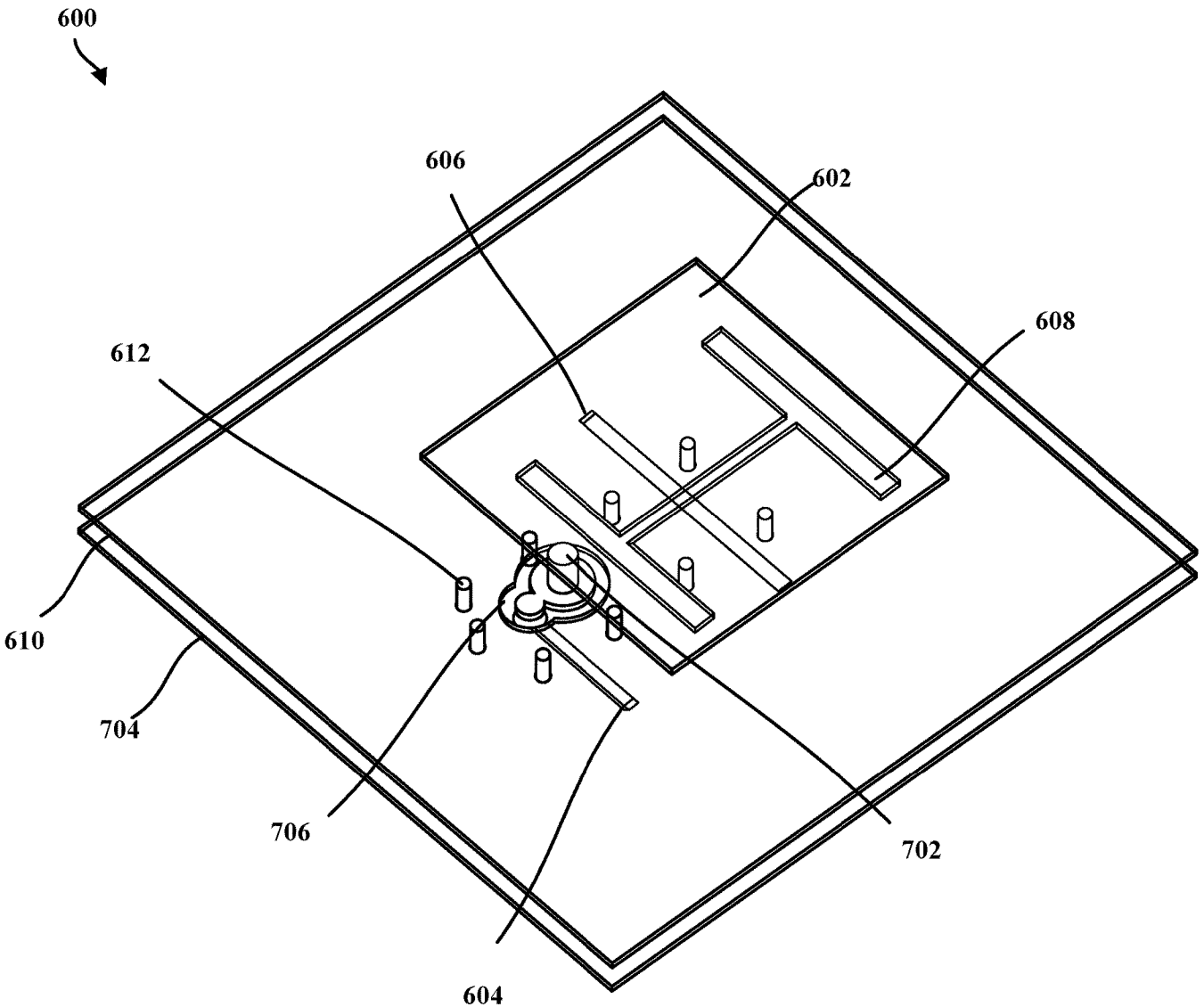
FIG. 7 is a diagram illustrating the example patch antenna having a probe feed and a slot-coupled feed of FIG. 6.

FIG. 7 is a diagram illustrating the example patch antenna 600 of FIG. 6 having the probe feed 604 and a slot-coupled feed 606. The probe feed 604 may include a pin or probe 702. The example patch antenna 600 also illustrates slots 608 in a first ground plane 610, as well as vias 612 that may connect the ground plane 610 to the second ground plane 704. The probe feed 604 and particularly the probe 702 may be configured with a clearance 706 on the first ground plane 610, e.g., so that the probe 702 does not short to the ground plane. The probe feed 604 and particularly the probe 702 may also be configured with a clearance 706 on the other ground planes, such as the second ground plane 704, although a clearance with the second ground plane 704 is not visible in FIG. 7.

Figure 8:
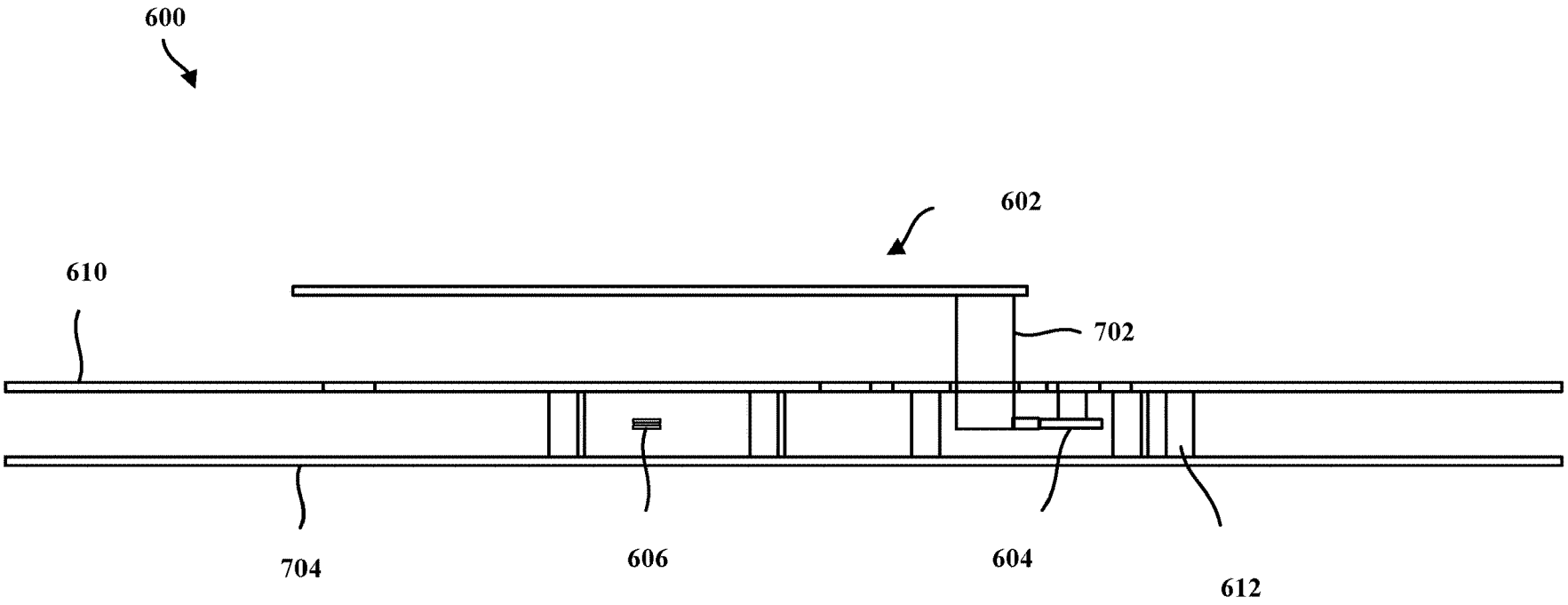
FIG. 8 is a diagram illustrating the example patch antenna having a probe feed and a slot-coupled feed of FIGS. 6-7.

FIG. 8 is a diagram illustrating the example patch antenna 600 having a probe feed 604 and a slot-coupled feed 606 of FIGS. 6-7. FIG. 8 illustrates a cut-away side view of the patch antenna 600. The patch 602 may be fed by the probe feed 604 and the slot-coupled feed 606. The probe feed 604 may include the probe 702, which is coupled to the patch 602. In an aspect, the probe 702 may touch the patch 602. For example, assuming the orientation illustrated in the figure, the top of the probe 702 mat be in contact with the bottom of the patch 602. The example patch antenna 600 also illustrates vias 612 that may connect the ground plane 610 to the second ground plane 704. For clarity, substrates between ground plane 610, ground plane 704, and patch 602 are not shown in FIG. 8.

FIGS. 6-8 illustrate an antenna (patch antenna 600) including a patch 602. The antenna (patch antenna 600) also includes a ground plane 610 having an opening or slot 608 defined therein. Additionally, the antenna (patch antenna 600) includes a first signal feed (probe feed 604) having at least a portion thereof disposed opposite the patch 602, for example with respect to the ground plane 610. In other words, a signal feed (probe feed 604 or portion thereof) may be situated face-to-face with the patch 602. For example, while the probe feed 604 may be smaller than the patch 602, a portion of the probe feed 604 may be in a corresponding position to the patch 602 with relation to an intervening space. The corresponding position does not necessarily need to be equidistant from the intervening space. In an aspect, the intervening space may include the ground plane 610. The antenna (patch antenna 600) also includes a conductor (see, e.g., the probe 702 in FIG. 7) coupled between the first signal feed (probe feed 604) and the patch 602. Additionally, the antenna (patch antenna 600) includes a second feed (slot-coupled feed 606) disposed opposite the patch 602. In other words, a signal feed (e.g., a transmission line of the slot-coupled feed 606) may be situated face-to-face with the patch 602 and near or close to the slot 608. For example, while the signal feed 606 may be smaller than the patch 602, the signal feed 606 may be in a corresponding position to the patch 602 with relation to an intervening space. The corresponding position does not necessarily need to be equidistant from the intervening space. In an aspect, the interleaving space may include the ground plane 610.

Figure 9B:
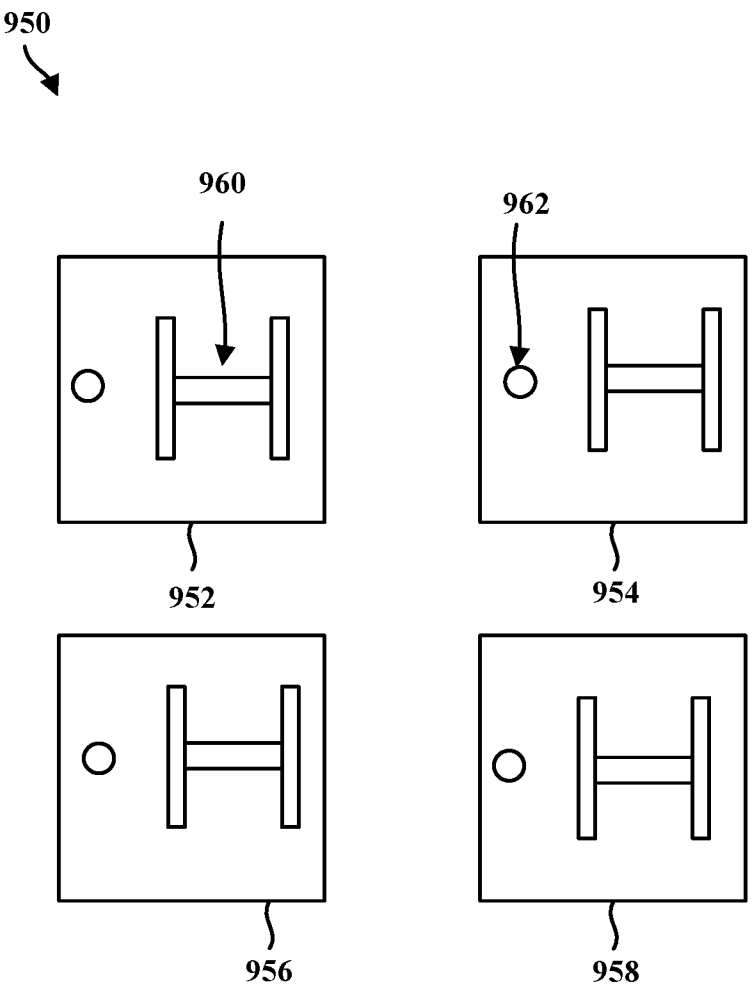
FIGS. 9A and 9B are diagrams illustrating example antenna slot-coupled feeds and probe feed combinations.
Figure 9A:
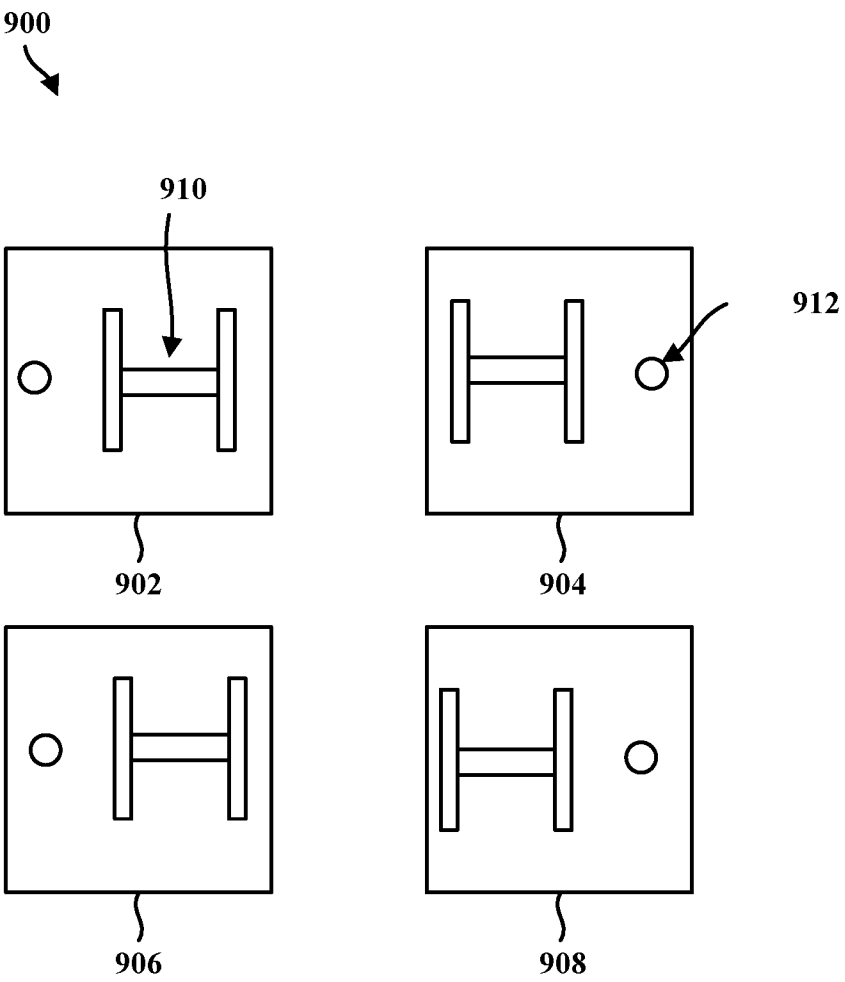

FIGS. 9A and 9B are diagrams of antenna arrays 900, 950 illustrating example antenna slots 910, 960 (that may form part of slot coupled feeds) and probe feed 912, 962 combinations 902, 904, 906, 908, 952, 954, 956, 958. In some embodiments, the arrays 900 and/or 950 may be configured to operate as phased arrays, and each may be implemented in an antenna module. The example antenna slots 910, 960 and probe feeds 912, 962 combinations 902, 904, 906, 908, 952, 954, 956, 958 each include a probe feed, as indicated by the circle and a slot-coupled feed as indicated by the slots. The slots in the particular examples form an "H" shape. It will be understood that many other types of slot-coupled feeds may be used in conjunction with the antenna designs described herein. As illustrated in FIG. 9A, the probe locations of the probe feeds in the antennas 902 and 904, and the probe locations of the probe feeds in antennas 906 and 908, may be at opposite sides of the individual antennas because the signal inputs at probe feeds 912 and 962 (and the signal inputs at the probe feeds 912 and 962) may have a 180 degree phase difference in some examples. Other examples may not have a 180-degree phase difference. Accordingly, FIG. 9B illustrates an antenna array 950 that uses uniformed probe locations for the probe feed combinations 952, 954, 956, 958.

In an aspect, patch to patch spacing (e.g., antennas 902 to 904 or antennas 902 to 906), may typically be lambda/2 as may be used in antenna arrays. The spacing between probe and slot on a particular antenna may vary, for example based on design optimizations such as impedance matching, isolation, some combination of these, or other design considerations.

Furthermore, while FIGS. 9A, 9B illustrate example configurations and orientations for various antennas as described herein, it will be understood that other configurations and orientations are possible. For example, the antenna does not need to be square or nearly square. In some aspects, other array configurations are possible, e.g., 1×4, or other array configurations. The relative positions of the probe and slot feed in FIGS. 9A, 9B are only examples. The relative positions of the probe and slot feed may be adjusted with respect to the array configuration while remaining linearly related to each other as in FIGS. 9A, 9B. In other examples, including examples that are square or nearly square, the probe and slot feeds may be offset from each other. Additionally, in the examples described herein, the patch 602 may be above the probe 702 which may extend up from the probe feed 604. The patch 602 may also be above the slot 608 which may be above the transmission line 328. Other orientations are also possible. For example, transmission lines for the probe feed and the slot coupled feed may each extend from the patch 602 in opposite directions rather than in the same direction, for one example. For example, a slot may be formed in a ground plane above the patch. Generally, the probe feed and the slot coupled feed may share a patch. Accordingly, the patch shared may be a single patch on a single layer. In an array of multiple antenna combinations, however, different patches may be spread across different layers, e.g., in a printed wire board.

FIG. 10 is a diagram illustrating example antenna slot-coupled feeds 1010 and probe feed 1012 combinations 1000 and polarizations 1050 for the example antenna slot-coupled feeds and probe feed combinations 1000. In some embodiments, the combinations 1000 may be configured to operate as a phased array, and may be implemented together in an antenna module. Example antenna slot-coupled feeds and probe feed combinations 1002 may have polarization 1052. The probe feed may radiate with polarization perpendicular to the vertical slots of the H shape slot. The slot-coupled feed may radiate with polarization parallel to the vertical slots of the H shape slot.

Example antenna slot-coupled feeds and probe feed combinations 1004 may have polarization 1054. The probe feed may radiate with polarization perpendicular to the vertical slots of the H shape slot. The slot-coupled feed may radiate with polarization parallel to the vertical slots of the H shape slot.

Example antenna slot-coupled feeds and probe feed combinations 1006 may have polarization 1056. The probe feed may radiate with polarization perpendicular to the vertical slots of the H shape slot. The slot-coupled feed may radiate with polarization parallel to the vertical slots of the H shape slot.

Example antenna slot-coupled feeds and probe feed combinations 1008 may have polarization 1058. The probe feed may radiate with polarization perpendicular to the vertical slots of the H shape slot. The slot-coupled feed may radiate with polarization parallel to the vertical slots of the H shape slot.

In the example of FIG. 10, the polarization arrows for polarization 1052, polarization 1054, polarization 1056, polarization 1058 are based on signal inputs at the probe feed combinations, e.g., 1002 and 1008 and probe feed combinations 1004 and 1006 that are 180 degrees out of phase.

In an aspect, the antenna gain from a probe feed may be higher than the antenna gain from the slot-coupled feed. In an aspect, the antenna array configuration illustrated in FIG. 10 may provide a balance for horizontal (H) and vertical (V) polarization array antenna gain. Additionally, the isolation for any pair of antennas having the same polarization (H or V) and the isolation between any pair of antennas having opposite polarizations (H and V) may be increased.

Figure 11:
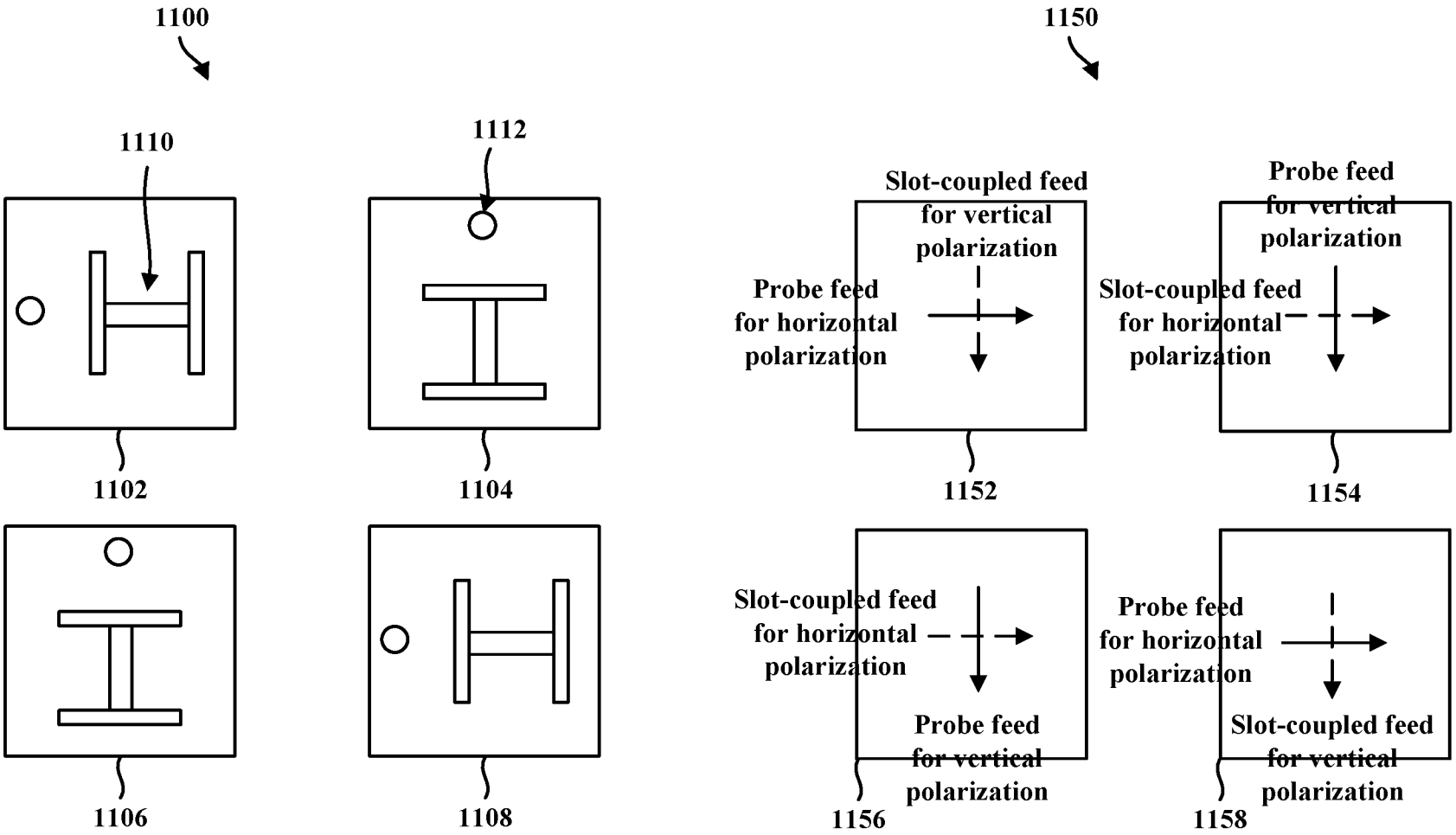
FIG. 11 is another diagram illustrating example antenna slot-coupled feeds and probe feed combinations and polarizations for the example antenna slot-coupled feeds and probe feed combinations.

FIG. 11 is a diagram illustrating example antenna slot-coupled feeds 1110 and probe feed 1112 combinations 1100 and polarizations 1150 for the example antenna slot-coupled feeds and probe feed combinations 1100. In some embodiments, the combinations 1100 may be configured to operate as a phased array, and may be implemented together in an antenna module. Example antenna slot-coupled feeds and probe feed combinations 1102 may have polarization 1152. The probe feed may radiate with polarization perpendicular to the vertical slots of the H shape slot. The slot-coupled feed may radiate with polarization parallel to the vertical slots of the H shape slot.

Example antenna slot-coupled feeds and probe feed combinations 1104 may have polarization 1154. The probe feed may radiate with polarization perpendicular to the vertical slots of the H shape slot. The slot-coupled feed may radiate with polarization parallel to the vertical slots of the H shape slot.

Example antenna slot-coupled feeds and probe feed combinations 1106 may have polarization 1156. The probe feed may radiate with polarization perpendicular to the vertical slots of the H shape slot. The slot-coupled feed may radiate with polarization parallel to the vertical slots of the H shape slot.

Example antenna slot-coupled feeds and probe feed combinations 1108 may have polarization 1158. The probe feed may radiate with polarization perpendicular to the vertical slots of the H shape slot. The slot-coupled feed may radiate with polarization parallel to the vertical slots of the H shape slot.

In the example of FIG. 11, the polarization arrows for polarization 1152, polarization 1154, polarization 1156, polarization 1158 are based on signal inputs at the probe feed combinations, e.g., 1102 and 1108 and probe feed combinations 1104 and 1106 that are not 180 degrees out of phase.

In an aspect, the antenna gain from a probe feed may be higher than the antenna gain from the slot-coupled feed. In an aspect, the antenna array configuration illustrated in FIG. 11 may provide a balance for horizontal (H) and vertical (V) polarization array antenna gain. Additionally, the isolation for any pair of antennas having the same polarization (H or V) and the isolation between any pair of antennas having opposite polarizations (H and V) may be improved.

Figure 12:
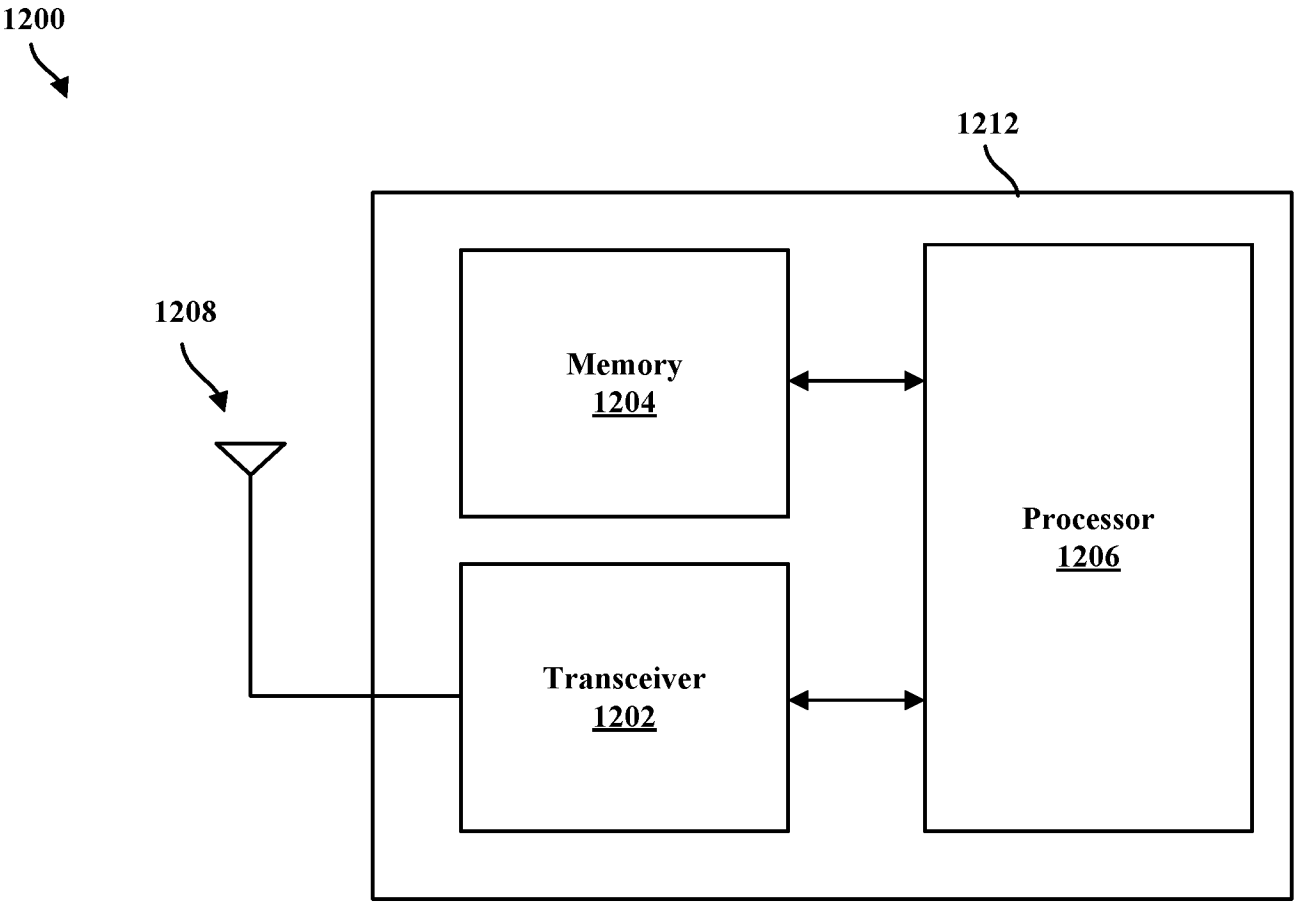
FIG. 12 is a diagram illustrating an example apparatus for wireless communication.

FIG. 12 is a diagram illustrating an example apparatus for wireless communication 1200. The apparatus for wireless communication 1200 includes a transceiver 1202, a memory 1204, and at least one processor 1206 coupled to the memory. The at least one processor may be configured to execute instructions stored in the memory 1204 to control the transceiver 1202.

The apparatus for wireless communication 1200 may also include an antenna 1208. The antenna 1208 may be a patch antenna, such as the patch antenna 300, 600. The antenna 1208 (e.g., patch antenna 300, 600) may be coupled to the transceiver 1202. Accordingly, the transceiver 1202 may transmit and receive signals from the antenna 1208 (e.g., patch antenna 300, 600). As discussed with respect to FIGS. 3-4 and 6-8, the patch antenna 300, 600 may include a patch 302, 602; a ground plane 322, 610, 704. Each ground plane 322, 610, 704 may be substantially equidistant from the patch antenna 300, 600; e.g., parallel in flat patch antenna designs. The patch antenna 300, 600 may also include a probe feed 304, 604 coupled to the patch 302, 602 and a slot-coupled feed 306, 606 coupled to the patch. In some embodiments, the antenna 1208 includes an antenna array, for example as illustrated and described with respect to FIGS. 9-11. While the antenna 1208 is illustrated outside of an enclosure 1212 of the device 1200 in FIG. 12, those of skill in the art will appreciate that the antenna 1208 may be implemented within the enclosure 1212 and/or integrated with the enclosure 1212. In some embodiments, the antenna 1208 is implemented within a module that includes circuitry (not illustrated in FIG. 12) configured to upconvert signals from the transceiver 1202 and/or downconvert signals being sent to the transceiver 1202 from the antenna 1208. Such module may further include filters, power conversion elements, etc.

Within the apparatus for wireless communication 1200, the patch antenna 300, 600 and the ground plane 322, 610, 704 may be substantially parallel.

Within the apparatus for wireless communication 1200, the patch antenna 300, 600 may further include a dielectric (e.g., substrate 324) between the patch antenna 300, 600 and the ground plane 322, 610, 704.

Within the apparatus for wireless communication 1200, the dielectric (e.g., substrate 324) may be substantially parallel to the patch 302, 602 and the ground plane 322, 610, 704.

Within the apparatus for wireless communication 1200, the probe feed 304 may be configured to generate a polarization (e.g., horizontal 502) substantially perpendicular to the polarization (e.g., vertical 504) of the slot-coupled feed 306.

Within the apparatus for wireless communication 1200, the probe feed 304, 604 may include a pin (e.g., probe 312, 702) coupling a pad 310 to the patch 302.

An aspect may include a patch antenna 300, 600. The patch antenna 300, 600 may include a patch 302, 602 and a ground plane 322, 610, 704. The ground plane 322, 610, 704 may be located with respect to the patch 302, 602. For example, the ground plane 322, 610, 704 and the patch 302, 602 may form layers of a circuit board. In an aspect, the ground plane 322, 610, 704 may be substantially equidistant from the patch 302, 602. The patch antenna 300, 600 may include a probe feed 304, 604 coupled to the patch 302, 602 and a slot-coupled feed 306, 606 coupled to the patch 302, 602.

In an aspect, the patch 302, 602 and the ground plane 322, 610, 704 are substantially parallel.

In an aspect, the patch antenna 300, 600 may include a dielectric (e.g., substrate 324) between the patch 302 and the ground plane 322.

In an aspect, the dielectric (e.g., substrate 324) may be substantially parallel to the patch 302, 602 and the ground plane 322, 610, 704.

In an aspect, the probe feed 304 may be configured to generate a polarization substantially perpendicular to the polarization of the slot-coupled feed 306.

In an aspect, the probe feed 304, 604 may include a pin coupling a pad 310 to the patch 302, 602 of the patch antenna 300, 600.

Figure 13:
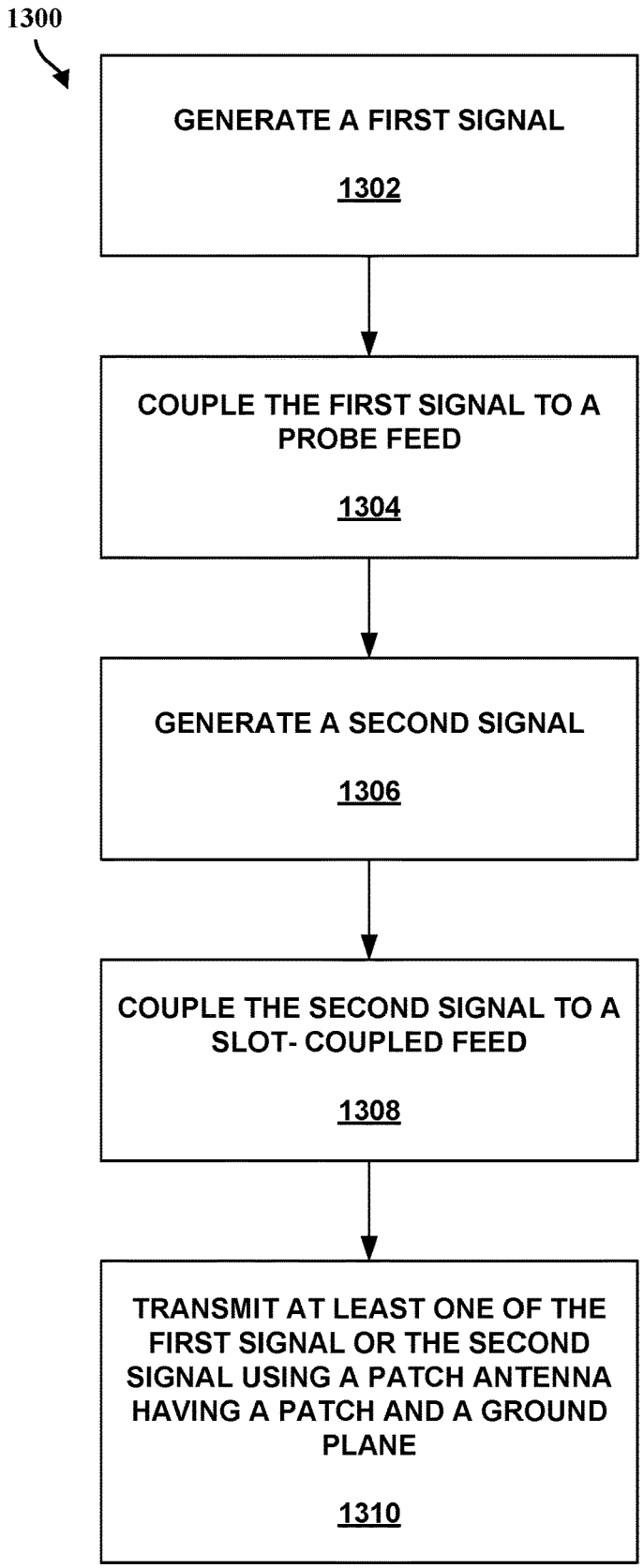
FIG. 13 is a flowchart of a method of wireless communication using a patch antenna.

FIG. 13 is a flowchart 1300 of a method of wireless communication using a patch antenna. At 1302, a first signal is generated. For example, the processor 1206 of FIG. 12 may generate a first signal. The first signal generated may be a signal that may need to be transmitted having a polarity that may be imparted by the antenna having the probe feed 304, 604.

At 1304, the first signal is coupled to the probe feed 304, 604. For example, the transceiver 1202 of FIG. 12 may couple the signal to the probe feed 304, 604. The first signal generated may be a signal that may need to be transmitted having a polarity that may be imparted by the antenna having the probe feed 304, 604. Accordingly, the first signal may be transmitted using the probe feed 304, 604.

At 1306, a second signal is generated. For example, the processor 1206 of FIG. 12 may generate the second signal. The second signal generated may be a signal that may need to be transmitted having a polarity (e.g., different than the polarity of the first signal) that may be imparted by the antenna having the slot-coupled feed 306, 606.

At 1308, the second signal is coupled to the slot-coupled feed 306, 606. For example, the transceiver 1202 of FIG. 12 may couple the signal to the slot-coupled feed 306, 606. The second signal generated may be a signal that may need to be transmitted having a polarity that may be imparted by the antenna having the slot-coupled feed 306, 606. Accordingly, the first signal may be transmitted using the slot-coupled feed 306, 606.

At 1310, at least one of the first signal or the second signal is transmitted using a patch antenna having a patch and a ground plane. For example, the first and second signals may be coupled to their corresponding feeds which may cause the signals to be transmitted by the antenna.

Some aspects may include means for generating a first signal. For example, the processor 1206 of FIG. 12 may execute code to generate a signal which may be transmitted to the transceiver 1202 of FIG. 12. Generating a first signal may include determining a signal to be transmitted, determining a modulation to use to transmit the signal, and generating a modulated signal including the signal to be transmitted.

Some aspects may include means for coupling the first signal to the probe feed 304, 604. For example, the transceiver 1202 of FIG. 12 may couple the first signal to the probe feed 304, 604, and/or other circuitry or components between the transceiver 1202 and the antenna 1208 may couple the first signal to the probe feed 304, 604.

Some aspects may include means for generating a second signal. For example, the processor 1206 of FIG. 12 may execute code to generate the second signal which may be transmitted to the transceiver 1202 of FIG. 12. Generating the second signal may include determining the second signal to be transmitted, determining a modulation to use to transmit the second signal, and generating a modulated signal including the second signal to be transmitted.

Some aspects may include means for coupling the second signal to the slot-coupled feed 306, 606. For example, the transceiver 1202 of FIG. 12 may couple the second signal to the slot-coupled feed 306, 606, and/or other circuitry or components between the transceiver 1202 and the antenna 1208 may couple the second signal to the probe feed 304, 604.

In an aspect, the patch and the ground plane of the patch antenna used are substantially parallel.

In an aspect, the patch antenna used further comprises a dielectric between the patch and the ground plane.

In an aspect, the dielectric is substantially parallel to the patch and the ground plane.

In an aspect, the probe feed of the patch antenna used is configured to generate a polarization substantially perpendicular to the polarization of the slot-coupled feed.

In an aspect, the probe feed of the patch antenna used comprises a pin coupling a pad to the patch.

In an aspect, the patch antenna used comprises a plurality of patch antennas forming an array of patch antennas.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more. Combinations such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, where any such combinations may contain one or more member or members of A, B, or C. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. The words "module," "mechanism," "element," "device," and the like may not be a substitute for the word "means." As such, no claim element is to be construed as a means plus function unless the element is expressly recited using the phrase "means for."

What is claimed is:

1. A patch antenna comprising:

a patch;

a ground plane having a single slot formed therein for the patch antenna, wherein the single slot is formed in an "H" shape, and wherein the "H" shape is not centered under the patch;

a probe feed in contact with the patch; and a transmission line, the patch antenna being configured to couple signals from the transmission line to the patch through the slot formed in the ground plane.

2. The patch antenna of claim 1, wherein the patch and the ground plane are formed as portions of different metal layers of a printed circuit board and are substantially parallel.

3. The patch antenna of claim 1, further comprising a dielectric between the patch and the ground plane.

4. The patch antenna of claim 3, wherein the dielectric is substantially parallel to the patch and the ground plane.

5. The patch antenna of claim 1, wherein the probe feed is configured to generate a polarization substantially perpendicular to the polarization of the slot-coupled feed.

6. The patch antenna of claim 1, wherein the probe feed comprises a pin coupling a pad to the patch.

7. The patch antenna of claim 1, the patch antenna being one antenna in an array of antennas, each of the antennas in the array of antennas comprising a probe feed and a single slot-coupled feed.

8. The patch antenna of claim 7, wherein the array comprises a second antenna, wherein a position of the probe feed relative to the slot-coupled feed in the patch antenna is rotated with respect to a position of the probe feed relative to the slot-coupled feed in the second antenna.

9. A plurality of patch antennas in an array, each of the plurality of patch antennas comprising:

a patch;

a ground plane having a slot formed therein;

a probe feed coupled to the patch; and a transmission line, the patch antenna being configured to couple signals from the transmission line to the patch through the slot formed in the ground plane, wherein the plurality of patch antennas are configured such that a polarization of a signal transmitted with a probe feed of a first antenna of the plurality of patch antennas is different than a polarization of a signal transmitted with a probe feed of a second antenna of the plurality of patch antennas.

10. The plurality of patch antennas of claim 9, wherein the patch and the ground plane are substantially parallel in each of the plurality of patch antennas.

11. The plurality of patch antennas of claim 9, further comprising a dielectric between the patch and the ground plane in each of the plurality of patch antennas.

12. The plurality of patch antennas of claim 11, wherein the dielectric in each of the plurality of patch antennas is substantially parallel to the patch and the ground plane in that patch antenna.

13. A method comprising:

generating a first signal;

coupling the first signal to a probe feed of a first antenna in an array;

transmitting the first signal with a first polarization using the first antenna;

generating a second signal;

coupling the second signal to a slot-coupled feed of the first antenna;

generating a third signal;

coupling the third signal to a probe feed of a second antenna in the array; and transmitting the third signal with a second polarization using the second antenna.

14. The method of claim 13, wherein the first antenna comprises a patch antenna having a patch and a ground plane, wherein transmitting the first signal comprises using the patch antenna, and wherein the patch and the ground plane of the patch antenna used are substantially parallel.

15. The method of claim 14, wherein the patch antenna further comprises a dielectric between the patch and the ground plane.

16. The method of claim 15, wherein the dielectric is substantially parallel to the patch and the ground plane.

17. The method of claim 13, further comprising transmitting the first signal and the second signal using the antenna with substantially perpendicular polarizations.

18. The method of claim 13, wherein the first antenna comprises a patch antenna having a patch and a ground plane, and wherein the probe feed comprises a pin coupling a pad to the patch.

19. The method of claim 13, wherein each of the first and second antennas comprises a patch antenna having a patch and a ground plane, and wherein the patch antennas form at least a portion of an array of patch antennas.

20. The method of claim 13, further comprising:

transmitting the second signal with the second polarization using the first antenna;

generating a fourth signal;

coupling the fourth signal to a slot-coupled feed of the second antenna; and transmitting the fourth signal with the first polarization using the second antenna.

21. An array of antennas, comprising:

a first antenna, comprising a first radiator;

a first feed of a first type configured to couple signals to the first radiator, wherein the first type comprises a probe feed; and a second feed of a second type configured to couple signals to the first radiator, wherein the first antenna is configured such that transmissions from the first antenna using the first feed are transmitted with a first polarization and transmissions from the first antenna using the second feed are transmitted with a second polarization that is substantially orthogonal to the first polarization; and a second antenna, comprising a second radiator;

a third feed of the first type configured to couple signals to the second radiator; and a fourth feed of the second type configured to couple signals to the second radiator, wherein a position of the first feed relative to the second feed is rotated with respect to a position of the third feed relative to the fourth feed.

22. The array of antennas of claim 21, wherein the first antenna comprises a patch antenna and the first radiator is substantially planar.

23. The array of antennas of claim 21, wherein the second type comprises a slot-coupled feed.

24. The array of antennas of claim 21, wherein the position of the first feed relative to the second feed is rotated by approximately ninety degrees with respect to the position of the third feed relative to the fourth feed.

* * * * *